US005601488A

United States Patent [19]

Kadlic

[11] Patent Number: 5,601,488

[45] Date of Patent: Feb. 11, 1997

[54] ELECTRONIC RUMMY GAME

[76] Inventor: Thomas P. Kadlic, 1750 S. Rainbow Blvd., Suite #2, Las Vegas, Nev. 89117

[21] Appl. No.: 336,271

[22] Filed: Nov. 8, 1994

[51] Int. Cl.[6] ..... A63F 1/00

[52] U.S. Cl. ..... 463/13; 273/292

[58] Field of Search ..... 273/85 CP, 274, 273/292, 309; 463/13

[56] References Cited

U.S. PATENT DOCUMENTS

| | | | |
|---|---|---|---|
| 4,380,334 | 4/1983 | Minkoff et al. | 273/85 CP |
| 5,042,818 | 8/1991 | Weingardt | 273/292 |
| 5,374,067 | 12/1994 | Jones | 273/292 |
| 5,380,012 | 1/1995 | Jones et al. | 273/292 |

*Primary Examiner*—Benjamin H. Layno
*Attorney, Agent, or Firm*—John Edward Roethel

[57] ABSTRACT

The present invention involves a game of chance based on the principles of rummy. An electronic gaming machine is programmed to display an initial seven card hand to the player. The player selects which of the initial seven cards to hold and which to discard. Replacement cards are displayed for the cards which have been discarded and the combinations created by the resulting seven card hand are compared against a payout table to determine which winning payoffs, if any, are received by the player. Preferred winning combinations are seven, six, five and four card runs, four and three card groups and the combination (sets) of three or four card runs and three or four card groups.

19 Claims, 1 Drawing Sheet

ELECTRONIC RUMMY GAME

This invention relates to an electronic rummy game, and more particularly to a rummy game designed to be displayed on an electronic gaming device for use in licensed gaming establishments.

BACKGROUND OF THE INVENTION

There have been many types of electronic video gaming machines that have been developed. The electronic video poker gaming machine is designed to replicate the play of a hand of poker. Typically, the player is not playing against any other players or against a dealer's hand; the player is simply attempting to achieve the highest ranking poker hand possible from the cards displayed to the player. The higher the poker hand achieved by the player, the greater the player's winnings based on the number of coins wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. A payout table is established based on the number of coins or tokens wagered by the player and the type of poker hand achieved.

The classic draw poker machine has been modified to use jokers as wild cards or to use deuces (or even other cards) as wild cards. "Joker's Wild," and "Deuces Wild" draw poker still display to the player a single five card hand and allow the player to discard unwanted cards and receive replacement cards. The payout table is modified to recognize the differing odds for achieving various poker hands when wild cards are involved.

Other types of poker games have been adapted to run on electronic video gaming machines. In the electronic version of seven card stud poker, the player wagers one or more coins to be eligible to play the game and the player is dealt three cards initially. The player then has the option of folding in which case he loses his initial wager or betting additional coins to receive additional cards. Eventually the player has either folded or received a full seven card hand. The player wins or loses based on conventional poker hand rankings for the best five cards of his seven card hand. A payout table is established based on the number of coins or tokens wagered by the player and the type of poker hand achieved.

In the electronic version of five card stud poker, the player wagers one or more coins to be eligible to play the game and the player is dealt four cards initially. The player then has the option of staying or betting additional coins to increase the amount of a winning payout when he receives the fifth card. After the fifth card is dealt to the player, the value of his five card hand-is determined based on conventional poker hand rankings for his five card hand. A payout table is established based on the number of coins or tokens wagered by the player and the type of poker hand achieved.

Some of the card games adapted to electronic video gaming machines display both the player's hand and a dealer's hand. This occurs in those games where the player must beat the dealer in order to win.

In the electronic version of Twenty-One, the player is dealt two cards and the dealer is dealt two cards from a conventional deck of playing cards. Only one of the dealer's cards is exposed to the player. The player stands or hits based on the conventional manner of play of Twenty-One and after the player has completed the play of his hand, the dealer stands or hits as is conventional. The player wins if his hand totals more than the dealer's hand without going over the total of 21. If the player has a winning hand, he is paid one-to-one odds based on the amount of his wager. Blackjacks pay three-to-two odds and electronic Twenty-One gaming machines can be programmed to allow the player to perform conventional Twenty-One features such as doubling down, splitting pairs and taking insurance.

Because of the proliferation of legalized gaming, the competition for players has increased. Operators of gaming machines have been increasing the payback percentage to attract players and the increase of the gaming percentage has resulted in a lowering of profits to the operators. There is a demand in the market for new gaming machines that create a higher volume of play so that profits can be increased even with the higher payback percentages that the players desire.

Rummy games have been popular card games played often in a family setting around the kitchen or dining room table. According to "Scarne's Encyclopedia of Games") Rummy evolved from Whiskey Poker. By the mid 1890's, there were three popular versions of poker being played (all so named because they were played in bars for alcoholic drinks): Whiskey Poker now known generally as Knock Rummy, Gin Poker now known as Gin Rummy and Rum Poker now known as Rummy.

Rummy is generally played using one or more decks of standard playing cards—the standard fifty-two card decks having four suits (Spades, Hearts, Diamonds and Clubs ranking upward from deuce through Ace). One of the basic, widespread principles of Rummy games is that the player must attempt to organize his hand into what are known as "groups" and "runs". A "group" is a collection of like cards, e.g. Kings, threes or sixes and normally a player must have either a three card group or a four card group. A "run" is a sequence of cards of the same suit, e.g. the four, five and six of Spades and normally a player must have a sequence of at least three cards in length.

It is an object of the present invention to provide a method of playing a game of chance based on rummy which is easily understood by the player.

It is a feature of the present invention to display a method of playing a game of chance based on rummy on an electronic gaming machine. An initial hand of cards is displayed to the player who discards and redraws replacement cards while attempting to achieve various winning combinations modelled after traditional rummy games.

It is an advantage of the present invention that a new and creative game of chance is provided to the player presenting multiple winning combinations based on traditional rummy combinations; while at the same time including high progressive jackpot amounts that may be achieved by the player.

Other objects, features and advantages of the present invention will become apparent from a consideration of the following detailed description.

SUMMARY OF THE INVENTION

The method of the present invention involves a game of chance based on the principles of rummy. An electronic gaming machine is programmed to display an initial seven card hand to the player. The player selects which of the initial seven cards to hold and which to discard. Replacement cards are displayed for the cards which have been discarded and the combinations created by the resulting seven card hand are compared against a payout table to determine which winning payoffs, if any, are received by the player. Preferred winning combinations are seven, six, five and four card runs, four and three card groups and the combination (sets) of three or four card runs and three or four card groups.

DETAILED DESCRIPTION OF THE PREFERRED EMBODIMENTS

Figure 1:
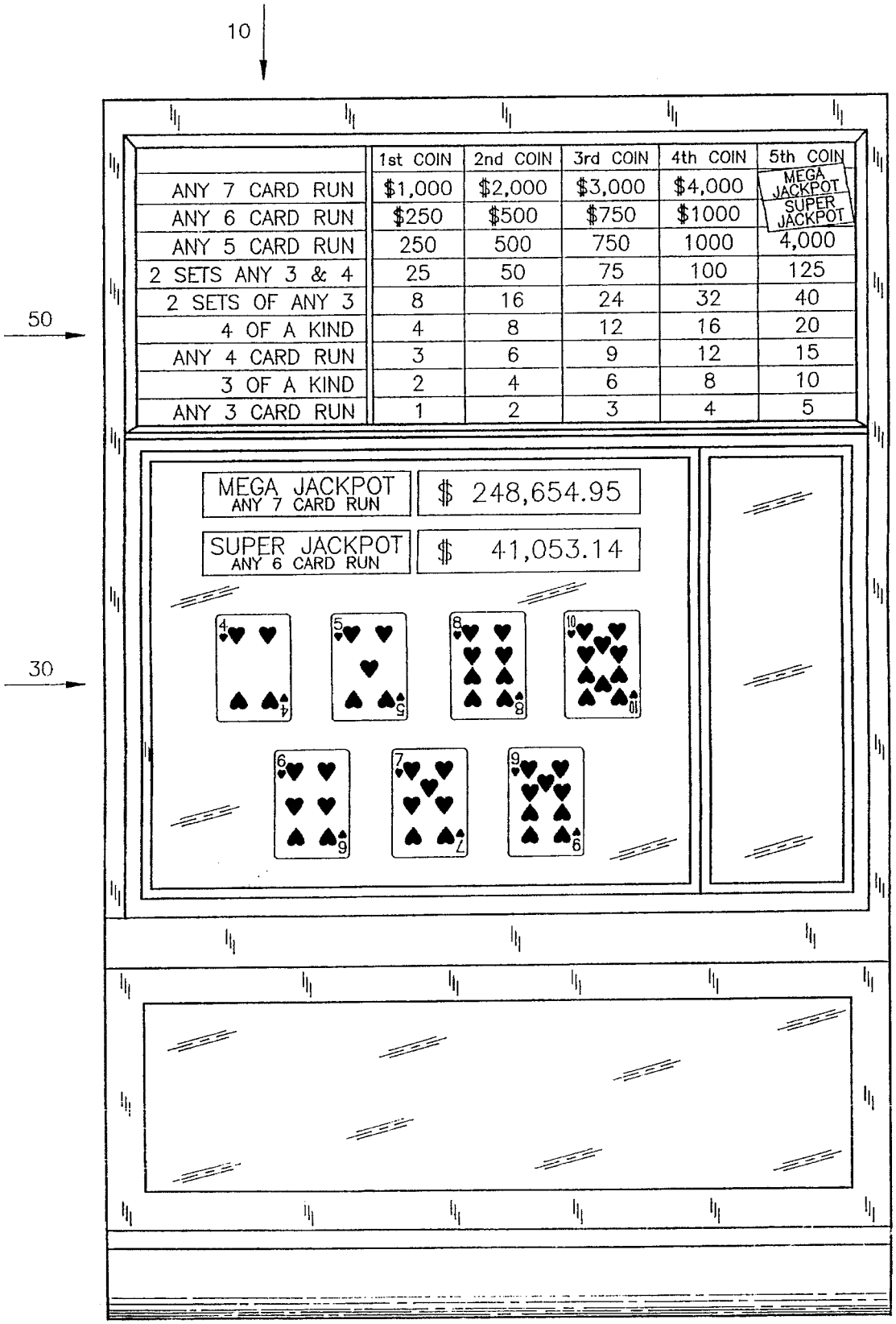
FIG. 1 shows a schematic representation of an electronic gaming machine displaying a seven card hand used in the practice of the method of the present invention.

In the preferred embodiment of the present invention, a standard deck of fifty-two playing cards is used. The cards have the conventional four suits (Spades, Hearts, Diamonds and Clubs) and rank in order from deuce through Ace.

An electronic gaming machine, shown at 10 in FIG. 1, is programmed to shuffle the standard deck of playing cards and randomly deal a single, initial hand to a player of seven cards. The initial hand is displayed on the video screen 30 and the player can select which of these initial seven cards he wishes to hold and which he wishes to discard. This selection is accomplished by using Hold/Discard buttons (not shown but conventional) provided on the gaming machine 30.

After the player selects which cards from the initial hand he wishes to hold and discard, the player activates the Deal button (not shown but conventional). The gaming machine 30 displays replacement cards for the discarded cards on the video screen 30. This final seven card hand is then used to determine whether the player has achieved a winning combination.

In the preferred embodiment of the present invention, nine winning hand combinations are used. The highest payoff for a winning combination is a seven card run: a sequence of seven cards in a row in the same suit. For example, the video screen 30 in FIG. 1 shows a player having achieved a seven card run, i.e. the 4♥, 5♥, 6♥, 7♥, 8♥, 9♥ and 10♥. The order that the cards appear on the video screen 30 does not matter; the hand is determined solely by the highest ranking combination that can be achieved by the seven cards on the video screen 30.

The next highest ranking hand is a six card run. This is followed in ranking by the five card run.

The fourth highest ranking hand is two sets of any three and any four card combination. There are four possible card arrangements that can achieve this combination: 1) a three card run and four-of-a-kind; 2) a four card run and three-of-a-kind; 3) a three card run and a four card run; and 4) a three-of-a-kind and a four-of-a-kind.

The fifth highest ranking hand is two sets of any three card combination. There are three possible card arrangements that can achieve this combination: 1) two three card runs; 2) two three-of-a-kinds; and 3) a three card run and three-of-a kind.

The four lowest ranking hands are four-of-a-kind, a four card run, three-of-a-kind and a three card run.

The winning combinations are posted to the player in the payout schedule 50, typically displayed on the gaming machine above the video screen 30. As explained below, the payout schedule is a matrix based on various winning combinations and the number of coins or the amount of the wager made by the player at the beginning of the round of play of the game.

Table 1 shows a typical payout schedule 50 that is used in the method of the present invention and displayed to the player on the electronic gaming machine 10. Any hand combination that is not shown on the payout schedule is a losing combination.

TABLE 1

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |
| FIVE CARD RUN | 25 | 50 | 75 | 100 | 250 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

Based on theoretical probabilities, the payout table shown in Table 1 has a payback percentage of approximately 99.12%, which means that the gaming machine holds approximately 0.88% of the money wagered. This payout schedule is shown for a "break-even" game and would not generate much revenue to the gaming establishment. This payout schedule is used as the starting point for determining other payout schedules. The payback percentage can be adjusted up or down based on the profitability that the operator of the gaming machine desires and whatever regulations are imposed upon the operator by the gaming authority that regulates the use of the gaming machine. Following are examples of payout schedules that can be used with or without progressive jackpots, where the progressive jackpots are funded from the money wagered into the gaming machine.

Table 2 shows one type of payout schedule that is suggested to be used when a progressive jackpot feature is used. The player can win the progressive jackpot when he achieves a seven card run with five coins wagered. This payout schedule maintains higher payouts for a Four Card Run while reducing the size of the payouts for a Seven Card Run.

TABLE 2

| Coins Played | 1st | 2nd | 3rd | 4th | 5th |
|---|---|---|---|---|---|
| SEVEN CARD RUN | 1000 | 2000 | 3000 | 4000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 89.8% which means that the gaming machine holds approximately 10.2% of the money wagered. In the preferred embodiment of the present invention, between 2% and 4% of this money can be added to the progressive jackpot, which allows the progressive jackpot to increase.

Such a result would yield approximately 6.2% to 8.2% as the return to the gaming establishment from the play of this machine.

Table 3 shows another different payout schedule that is suggested to be used when a progressive jackpot feature is used. The player can win the progressive jackpot when he achieves a seven card run with five coins wagered. This payout schedule maintains higher payouts for the Seven Card Run while reducing the payouts for a Four card Run.

TABLE 3

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule also yields a payback percentage of approximately 90% which means that the gaming machine holds approximately 10% of the money wagered. In the preferred embodiment of the present invention, between 2% and 4% of this money can be added to the progressive jackpot, which allows the progressive jackpot to increase. Such a result would yield approximately 6% to 8% as the return to the gaming establishment from the play of this machine.

Table 4 shows another different payout schedule that is suggested to be used when the method of the present invention is practiced without a progressive jackpot feature. This payout schedule maintains higher payouts for the Seven Card Run while reducing the payouts for a Four Card Run.

TABLE 4

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule also yields a payback percentage of approximately 94.6% which means that the gaming machine holds approximately 5.4% of the money wagered. This payout schedule results in a gaming machine that competes quite favorably with standard video Draw Poker.

Table 5 shows another different payout schedule that is suggested to be used when the method of the present invention is practiced without a progressive jackpot feature. This payout schedule maintains higher payouts for the Five Card Run, the Sets of 3 & 4, and the Four Card Run while reducing the payouts for a Six Card Run.

TABLE 5

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | 1250 |

TABLE 5-continued

| Coins Played | 1st | 2nd | 3rd | 4th | 5th |
|---|---|---|---|---|---|
| FIVE CARD RUN | 25 | 50 | 75 | 100 | 125 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 94.6% which means that the gaming machine holds approximately 5.4% of the money wagered. This payout schedule will compete quite favorably with standard video Draw Poker and will be popular in gaming establishments that provide players with higher intermediate payouts.

Finally Table 6 shows one type of payout schedule that is suggested to be used when two progressive jackpots are used. The player can win the higher progressive jackpot when he achieves a Seven Card Run with five coins wagered and the player can win the lower progressive jackpot when he achieves a Six Card Run with five coins wagered. This payout schedule maintains lower payouts in the intermediate categories while providing for a large progressive jackpot in two hand combinations.

TABLE 6

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | Prog. |
| FIVE CARD RUN | 20 | 40 | 60 | 80 | 100 |
| SETS OF 3 & 4 | 12 | 24 | 26 | 48 | 60 |
| FOUR OF A KIND | 8 | 16 | 24 | 32 | 40 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 88.2% which means that the gaming machine holds approximately 11.8% of the money wagered. In the preferred embodiment of the present invention, approximately 6% of this money can be added to the progressive jackpots (for example 4% to the large jackpot and 2% to the small jackpot), which allows the progressive jackpots to increase. Such a result would yield approximately 6% as the return to the gaming establishment from the play of this machine.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game on an electronic gaming machine having a video display of playing cards and that uses only a player's hand to determine winning and losing outcomes comprising:

a) a player making a wager of at least one coin to be eligible to participate in the game;

b) pre-establishing a group of winning card combinations for the card game, the winning card combinations consisting of a Seven Card Run, a Six Card Run, a Five Card Run, a Set of 3 & 4, a Four-of-a-Kind, a Four Card Run, a Set of 3 & 3, a Three-of-a-Kind and a Three Card Run;

c) displaying seven cards from a standard deck of playing cards;

d) the player selecting which of the seven cards the player wishes to hold and which of the seven cards the player wishes to discard;

e) displaying replacement cards for those cards that the player has discarded;

f) determining whether the resulting seven cards form a winning combination from the pre-established group of winning card combinations;

g) paying the player a predetermined amount if the player achieves a winning combination of playing cards.

2. The method of claim 1 in which the winning card combinations are associated in a payout schedule based on the number of coins wagered by the player.

3. The method of claim 2 in which the payout schedule consists essentially of:

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |
| FIVE CARD RUN | 25 | 50 | 75 | 100 | 250 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

4. The method of claim 2 in which the payout schedule consists essentially of:

| Coins Played | 1st | 2nd | 3rd | 4th | 5th |
|---|---|---|---|---|---|
| SEVEN CARD RUN | 1000 | 2000 | 3000 | 4000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

5. The method of claim 2 in which the payout schedule consists essentially of:

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

6. The method of claim 2 in which the payout schedule consists essentially of:

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |

-continued

| Coins Played | 1st | 2nd | 3rd | 4th | 5th |
|---|---|---|---|---|---|
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

7. The method of claim 2 in which the payout schedule consists essentially of:

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | 1250 |
| FIVE CARD RUN | 25 | 50 | 75 | 100 | 125 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

8. The method of claim 2 in which the payout schedule consists essentially of:

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | Prog. |
| FIVE CARD RUN | 20 | 40 | 60 | 80 | 100 |
| SETS OF 3 & 4 | 12 | 24 | 26 | 48 | 60 |
| FOUR OF A KIND | 8 | 16 | 24 | 32 | 40 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

9. A method of playing a card game on an electronic gaming machine operated by a player and that uses only a player's hand to determine winning and losing outcomes comprising:

a) displaying seven cards from only one standard deck of playing cards;

b) the player selecting which of the seven cards the player wishes to hold and which of the seven cards the player wishes to discard;

c) displaying replacement cards from the one standard deck for those cards that the player has discarded;

d) determining whether the resulting seven cards form a seven card run;

e) providing the player an award if a seven card run results.

10. A method of playing a card game on an electronic gaming machine operated by a player and that uses only a player's hand to determine winning and losing outcomes comprising:

a) displaying seven cards from only one standard deck of playing cards;

b) the player selecting which of the seven cards the player wishes to hold and which of the seven cards the player wishes to discard;

c) displaying replacement cards from the one standard desk for those cards that the player has discarded;

d) determining whether the resulting seven cards form a six card run;

e) providing the player an award if a six card run results.

11. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a four card run;

e) providing the player an award if a four card run results.

12. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a three card run;

e) providing the player an award if a three card run results.

13. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of a four card run and a three card run;

e) providing the player an award if a set of a four card run and a three card run results.

14. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of a four-of-a-kind and a three-of-a-kind;

e) providing the player an award if a set of a four-of-a-kind and a three-of-a-kind results.

15. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of a four card run and a three-of-a-kind;

e) providing the player an award if a set of a four card run and a three-of-a-kind results.

16. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of a three card run and a four-of-a-kind;

e) providing the player an award if a set of a three card run and a four-of-a-kind results.

17. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of two three card runs;

e) providing the player an award if a set of two three card runs result.

18. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of two three-of-a-kinds;

e) providing the player an award if a set of two three-of-a-kinds result.

19. A method of playing a card game on an electronic gaming machine operated by a player and that uses only a player's hand to determine winning and losing outcomes comprising:

a) displaying seven cards from a standard deck of playing cards;

b) the player selecting which of the seven cards the player wishes to hold and which of the seven cards the player wishes to discard;

c) displaying replacement cards for those cards that the player has discarded;

d) determining whether the resulting seven cards form a set of a three card run and a three-of-a-kind;

e) providing the player an award if a set of a three card run and a three-of-a-kind results.

* * * * *